US009748665B2

(12) United States Patent
Anderson et al.

(10) Patent No.: US 9,748,665 B2
(45) Date of Patent: Aug. 29, 2017

(54) RIDGED WAVEGUIDE FLARED RADIATOR ARRAY USING ELECTROMAGNETIC BANDGAP MATERIAL

(75) Inventors: Joseph M. Anderson, Tucson, AZ (US); Jared W. Jordan, Sahuarita, AZ (US); Charles G. Gilbert, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1051 days.

(21) Appl. No.: 13/457,547

(22) Filed: Apr. 27, 2012

(65) Prior Publication Data

US 2013/0241791 A1 Sep. 19, 2013

Related U.S. Application Data

(60) Provisional application No. 61/611,823, filed on Mar. 16, 2012.

(51) Int. Cl.
*H01Q 21/00* (2006.01)
*H01Q 13/06* (2006.01)
(Continued)

(52) U.S. Cl.
CPC ..... *H01Q 21/0081* (2013.01); *H01Q 13/06* (2013.01); *H01Q 13/085* (2013.01);
(Continued)

(58) Field of Classification Search
CPC .... H01Q 13/0283; H01Q 21/00; H01P 11/00; H01P 5/107
(Continued)

(56) References Cited

U.S. PATENT DOCUMENTS 4,063,248 A * 12/1977 Debski et al. ..... 343/727
4,427,984 A * 1/1984 Anderson ..... 343/764
(Continued)

FOREIGN PATENT DOCUMENTS

FR 2 691 014 11/1993
WO WO 02/052674 A1 7/2002

OTHER PUBLICATIONS

Lai et al., "Infinite Wavelength Resonant Antennas With Monopolar Radiation Pattern Based on Periodic Structures," IEEE Transactions on Antennas and Propagation, vol. 55, No. 3, Mar. 2007.*
(Continued)

*Primary Examiner* — Jessica Han
*Assistant Examiner* — Daniel J Munoz
(74) *Attorney, Agent, or Firm* — Daly, Crowley, Mofford & Durkee, LLP

(57) ABSTRACT

Presently disclosed is an antenna system having an array of ridged waveguide Vivaldi radiator (RWVR) antenna elements fed through a corporate network of suspended air striplines (SAS) with an electromagnetic bandgap (EBG) ground plane surrounding the ridged waveguide transition. The SAS transfers the electromagnetic energy to the radiating element via the ridged waveguide coupler. The Vivaldi radiator matches the output impedance of the ridged waveguide coupler/SAS to the intrinsic impedance of the surrounding medium. The EBG, which may be comprised of a photonic bandgap material or other metamaterial, allows for better frequency and bandwidth performance in a lower-profile array package, thereby reducing size and weight of the array for applications requiring small size and or low-inertia packaging. In alternate embodiments, radiating elements other than Vivaldi radiators may be used. This configuration also reduces the complexity of the manufacturing process, which in turn lowers cost.

24 Claims, 8 Drawing Sheets

(51) Int. Cl.
*H01Q 13/08* (2006.01)
*H01Q 15/00* (2006.01)

(52) U.S. Cl.
CPC ..... *H01Q 15/006* (2013.01); *H01Q 15/008* (2013.01); *H01Q 21/0087* (2013.01); *Y10T 29/49016* (2015.01)

(58) Field of Classification Search
USPC ..... 343/771, 841
See application file for complete search history.

(56) References Cited

U.S. PATENT DOCUMENTS

| | | | | |
|---|---|---|---|---|
| 5,264,860 | A * | 11/1993 | Quan | 343/767 |
| 5,361,049 | A | 11/1994 | Rubin et al. | |
| 5,506,589 | A | 4/1996 | Quan et al. | |
| 6,052,889 | A * | 4/2000 | Yu et al. | 29/600 |
| 6,175,337 | B1 | 1/2001 | Jasper, Jr. et al. | |
| 6,271,799 | B1 * | 8/2001 | Rief et al. | 343/776 |
| 6,545,647 | B1 | 4/2003 | Sievenpiper et al. | |
| 6,952,190 | B2 | 10/2005 | Lynch et al. | |
| 7,307,596 | B1 * | 12/2007 | West | 343/778 |
| 7,522,105 | B1 | 4/2009 | LaComb | |
| 2004/0233112 | A1 * | 11/2004 | Aisenbrey | 343/70 MS |
| 2007/0224737 | A1 * | 9/2007 | Berlin et al. | 438/141 |
| 2009/0303128 | A1 * | 12/2009 | Robert et al. | 342/373 |
| 2011/0050527 | A1 | 3/2011 | Anderson et al. | |

OTHER PUBLICATIONS

Bell et al.: "A Low-Profile Archimedean Spiral Antenna Using an EGB Ground Plane; IEEE Antennas and Wireless Propagation Letters," vol. 3, Issue 1; Dec. 2004; pp. 223-226.

Palmer; "Intellectual Ventures Invents Beam-Steering Metamaterials Antenna;" IEEE Inside Technology Spectrum; http://spectrum.ieee.org/telecom/wireless/intellectual-ventures-invents-beamsteering-metamaterials-antenna/?utm_source=techalert&utm_medium=email&utm_campaign=120111; Jan. 2012; 2 pages.

Anderson et al.; "Ridged Waveguide Flared Radiator Antenna;" U.S. Appl. No. 13/457,546, filed Apr. 27, 2012; 21 pages 21 pages.

Bell, et al.; "A Low-Profile Archimedean Spiral Antenna Using an EBG Ground Plane;" IEEE Antennas and Wireless Propagation Letters; vol. 3; Jul. 2004; pp. 223-226.

Chun, et al.; "Modeling and Characterization of Cavity Backed Circular Aperture Antenna With Suspended Stripline Probe Feed;" IEEE Antennas and Propagation Society International Symposium; vol. 2; Jul. 16-21, 2000; pp. 774-777.

Rammos; "A New Widebrand, High Gain Suspended Substrate Line Planar Array for 12 GHz Satellite T.V.;" Microwave Conference; 13$^{th}$ European; IEEE; Sep. 3, 1983; pp. 227-231.

PCT Search Report of the ISA for PCT/US2012/067587 dated Apr. 18, 2013.

Written Opinion of the ISA for PCT/US2012/067587 dated Apr. 18, 2013.

PCT Search Report of the ISA for PCT/US2012/067582 dated Apr. 23, 2013.

Written Opinion of the ISA for PCT/US2012/067582 dated Apr. 23, 2013.

Office Action dated Jan. 30, 2014, U.S. Appl. No. 13/457,546, filed Apr. 27, 2012, pp. 1-20.

Office Action dated Jan. 30, 2014 for U.S. Appl. No. 13/457,546, filed Apr. 27, 2012.

Response to Office Action as filed on Apr. 29, 2014, for U.S. Appl. No. 13/457,546, filed Apr. 27, 2012.

Department of the Navy; "Naval Shore Electronics Criteria;" Installation Standards and Practices; Navelex 0101, 110; Chapter 13; Jun. 1972; 31 pages.

Whitaker; "The Electronic Handbook;" CRC Press; A CRC Handbook Published in Cooperation with IEEE Press; Chapter 20; 1996; 12 pages.

Examiner's Amswer dated Sep. 1, 2015, for U.S. Appl. No. 13/457,546; 10 pages.

Notification Concerning Transmittal of International Preliminary Report on Patentability (Chapter I of the Patent Cooperation Treaty), PCT/US2012/067587, Sep. 25, 2014, 6 pages.

Notification Concerning Transmittal of International Preliminary Report on Patentability (Chapter I of the Patent Cooperation Treaty), PCT/US2012/067582, Sep. 25, 2014, 6 pages.

Response to Final Office Action dated Jul. 14, 2014, U.S. Appl. No. 13/457,548, filed Oct. 14, 2014, 18 pages.

Notice of Allowance for Application No. 12 799 472.1-1812 dated Apr. 14, 2015.

Notice of Allowance for Application No. 12 816 164.3-1812 dated Apr. 13, 2015.

* cited by examiner

RIDGED WAVEGUIDE FLARED RADIATOR ARRAY USING ELECTROMAGNETIC BANDGAP MATERIAL

GOVERNMENT LICENSE RIGHTS

This invention was made with Government support under N00024-07-C-5432 awarded by the Naval Sea Systems Command. The Government has certain rights in the invention.

CROSS-REFERENCE TO RELATED APPLICATIONS

This application CLAIMS PRIORITY to U.S. Provisional Application Ser. No. 61/611,823, filed on Mar. 16, 2012, which is incorporated herein by reference in its entirety.

BACKGROUND

This invention relates to the manufacture and structure of a radio frequency (RF) antenna, to a compact antenna element for use in a compact array antenna.

As is known in the art, there is a trend to provide increasingly compact RF antennas for use in radar systems used in airborne or land based seekers, including, but not limited to, direction finding (DF) systems and airborne vehicles (e.g. airplanes and unmanned vehicles).

As is also known, it is relatively difficult to provide compact antennas having high gain and large bandwidth and which are also relatively easy to manufacture at a relatively low cost. Current state of the art struggles to accomplish all of the above in one design. One prior art example of a solution to this problem is found in U.S. Pat. No. 6,052,889, to Yu, et al., (Yu '889). In that apparatus, the inventors attempt to address the above-noted need for an inexpensive compact, high grain, large bandwidth antenna by injection molding a group of broadband RF radiating elements from a polymeric material, metalizing each broadband radiating element, and installing a transmission line within each radiating element. While this design provides excellent antenna performance, it requires a complicated manufacturing process.

As is also known, conventional electric ground planes limit the minimum height of an antenna to one quarter of a wavelength since the current images projected onto the electric conductor that forms the ground plane are 180 degrees out of phase. Antenna currents that are less than a quarter of a wavelength from the electric conductor start to "short out" with their respective images, resulting in poor radiation efficiency.

To overcome this problem, electromagnetic bandgap (EBG) structures and materials (also referred to as photonic bandgap material or "metamaterial") have been used. EBG structures have been utilized in commercial devices such as cell phones to aid in antenna size reduction. The use of an EBG ground plane is different than a traditional electric ground plane (e.g. a perfect electrically conducting (PEG) ground plane) since an EBG ground plane essentially acts like a magnetic conductor. Since image currents induced onto a magnetic conductor are in-phase with antenna currents, the antenna's height is no longer restricted and antenna features can now reside just above the ground plane while still providing good radiation efficiency. Thus, the use of an EBG material in a ground plane allows antenna elements to be placed very near to the ground plane without shorting the element.

The use of similar, alternate ground plane materials (specifically, a high-impedance metallic surface) is discussed in U.S. Pat. No. 6,545,647 to Sievenpiper, et al., incorporated herein by reference in its entirety.

U.S. Pat. No. 6,952,190 to Lynch, et al. (incorporated herein by reference in its entirety) discusses so-called "low profile" slot antenna using a backside fed high-Z material in the vein of Sievenpiper.

The use of EBG metamaterials as a ground plane for an Archimedean spiral antenna is described in Jodie M. Bell and Magdy F. Iskander, "A Low-Profile Archimedean Spiral Antenna Using an EBG Ground Plane," IEEE Antennas And Wireless Propagation Letters, vol. 3, 2004, incorporated herein by reference in its entirety. Similarly, U.S. Pat. No. 6,175,337 to Jasper, et al., (incorporated herein by reference in its entirety) describes a photonic bandgap as a "high-impedance electromagnetic structure" used in a slotted waveguide antenna.

SUMMARY

In contrast to the above-described conventional approaches, embodiments of the present antenna system are directed to an array of ridged waveguide Vivaldi radiator (RWVR) antenna elements disposed over a ground plane provided from an electromagnetic bandgap (EBG) material. The RWVR antenna elements are fed through a corporate feed network, which includes a suspended air stripline (SAS) transmission medium. In some embodiments, each RWVR antenna element in an array of such elements is fed by an SAS transmission line and electromagnetic energy is coupled between each RWVR antenna element and the SAS transmission line via a ridged waveguide coupler. The RWVR antenna element gradually matches the output impedance of the ridged waveguide coupler/SAS to an intrinsic impedance of the surrounding medium. In one exemplary embodiment, at least portions of a ground plane below each RWVR antenna element are provided as an EBG ground plane. In other embodiments, the entire ground plane is provided as an EBG ground plane (either for a single element or an array of such elements). Using a ground plane provided partially or entirely as an EBG ground plane reduces, and in some cases, minimizes the overall height of each RWVR antenna element. With this approach, the RWVR antenna element antenna elements are provided as low-profile antenna elements. An antenna array comprised of a plurality of such low-profile RWVR antenna elements results in a concomitant reduction in the weight and inertia of the antenna array.

Furthermore, the EBG ground plane disposed under the RWVR antenna elements surrounds the ridged waveguide transitions. By surrounding the ridged waveguide transition, any additional array thickness necessary for the creation of the magnetic ground plane is reduced and possibly minimized.

The EBG will allow for a lower height antenna element thus reducing the overall thickness. Reducing the array's overall thickness further reduces its inertia, which in turn significantly reduces the load on an array mounting structure, such as the gimbals in a missile seeker head or similar applications.

Furthermore, the use of the EBG ground plane allows one to extend the operating frequency and bandwidth of an RWVR array beyond that achievable with a conventional ground plane for a given RWVR antenna element height.

This too is highly advantageous in compact antenna applications such as on missile seekers employing a gimbaled array.

The antenna array described herein utilizes coupling methods and radiating elements capable of operating over a relatively wide bandwidth. Thus, the antenna array described herein is capable of wideband operation. Advantageously, the directivity of an individual RWVR element is relatively high in comparison to other types of array elements such as dipoles or radiating slots.

Also, designing an array with RWVR elements is not limited to resonant element spacing, as is the case with radiating slots from a resonant waveguide, for example. This provides an antenna designer with an additional degree of freedom (i.e., modified spacing) to adjust side lobe levels or other antenna characteristics. Furthermore, since the bandwidth of RWVR antenna elements is relatively large, the electrical performance of an antenna provided from an array of RWVR antenna elements is less sensitive to tolerances in physical dimensions as are other antenna designs. This allows one to reduce the occurrence of an out-of-specification antenna due to manufacturing tolerance build-up. This also reduces the complexity of the manufacturing process (e.g. due to the ability to utilize higher manufacturing tolerances), which in turn lowers cost.

In accordance with a further aspect of the concepts, techniques, systems, and circuits described herein, a radio frequency (RF) antenna includes a housing having a suspended air stripline (SAS) transmission line disposed therein. A first end of the SAS transmission line is electrically coupled to a first port of a ridged waveguide (RWG) coupler through an aperture in the housing. A second port of the end of the RWG coupler is coupled to one or more antenna elements. The one or more antenna elements are thus configured to couple electromagnetic energy from the SAS transmission line, through the RWG coupler, and into free space. The RF antenna further includes an electromagnetic bandgap (EBG) ground plane disposed on the housing substantially surrounding the RWG coupler and the one or more antenna elements.

With this particular arrangement, a compact (i.e. low profile), versatile, and simplified antenna is provided. In one embodiment, the EBG may be comprised of a photonic bandgap material and/or a metamaterial. The antenna may employ one or more radiating elements or more specifically, one, two, or four elements. In one embodiment, the antenna includes a corporate feed network coupled to a second end of the SAS transmission line. In some exemplary embodiments, the SAS, the RWG, and the one or more radiating elements are each configured to efficiently transmit electromagnetic signals in at least one of the C, X, Ku, and Ka-band. In some exemplary embodiments, the one or more radiating elements may comprise a Vivaldi radiator, a flared radiator, a horn radiator, or a spiral radiator. In still another exemplary embodiment, the radiating elements and/or the RWG coupler may be comprised of a conductive material such as (but without limitation) a polymer. In still another exemplary embodiment, the radiating elements and/or the RWG coupler may be comprised of a non-conductive material such as (but without limitation) a polymer that has a conductive surface coating.

In some embodiments of the concepts, systems, and techniques disclosed herein, the one or more radiating elements and the RWG coupler may be monolithically formed. In some embodiments, the antenna may be a receive antenna, a transmit antenna, or be configured to both receive and transmit electromagnetic energy.

In accordance with a still further aspect of the concepts described herein, a method of communicating with electromagnetic energy representing information, includes furnishing a suspended air stripline (SAS) disposed in a housing, the SAS having a proximate end and a distal end; furnishing a ridged waveguide (RWG) coupler having a proximal end and a distal end, the proximal end of the RWG coupler disposed substantially in an aperture in the housing and coupled thereto, the aperture located above the distal end of the SAS; placing an electromagnetic bandgap (EBG) ground plane on said housing substantially surrounding said RWG coupler; attaching one or more radiating elements coupled to the distal end of said RWG; and coupling a supplied electromagnetic energy from the proximate end of said SAS, through said RWG, and into free space to communicate said information represented thereby.

This summary is provided to introduce a selection of concepts in a simplified form that are further described below in the Detailed Description. This summary is not intended to and should not be construed as limiting the scope of the claimed subject matter.

BRIEF DESCRIPTION OF THE DRAWINGS

The foregoing and other objects, features and advantages of the concepts, systems, techniques and circuit described herein will be apparent from the following description of particular embodiments as illustrated in the accompanying drawings in which like reference characters refer to the same parts throughout the different views. The drawings are not necessarily to scale, emphasis instead being placed upon illustrating the principles of the concept, systems, techniques and circuits described herein.

DETAILED DESCRIPTION

The term "forward" is used herein to describe a direction towards the radiating aperture of an antenna, and the terms "back" and "backward" is used to describe the opposing direction. The forward end of an element is in the forward direction and the back end of an element is in the backward direction.

Figure 1:
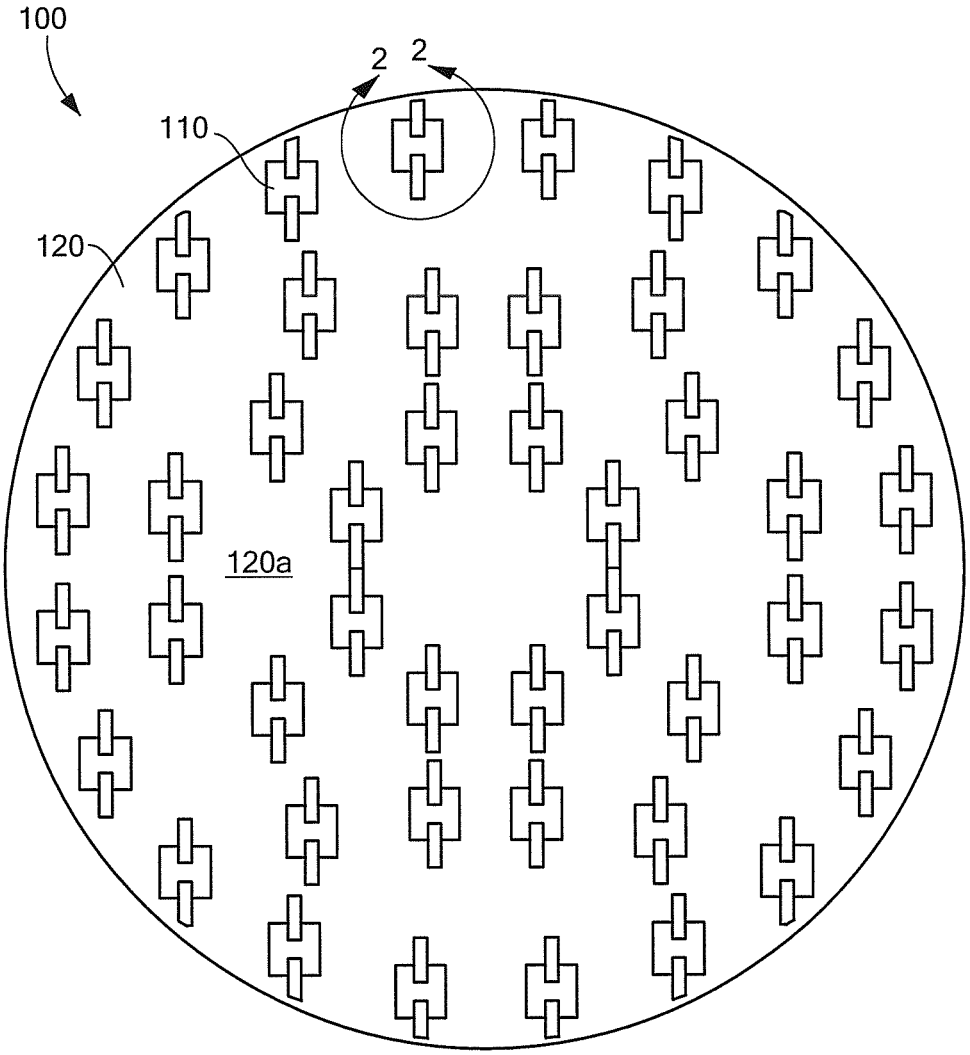
FIG. 1 is a top view of an array antenna provided from an array of ridged waveguide Vivaldi radiators (RWVR) antenna elements.

Embodiments of the present apparatus are directed to an array of ridged waveguide Vivaldi radiator (RWVR) antenna elements fed by a corporate network implemented, at least in part, using of suspended air stripline (SAS) transmission lines, such as the configuration shown in FIG. 1.

Figure 1A:
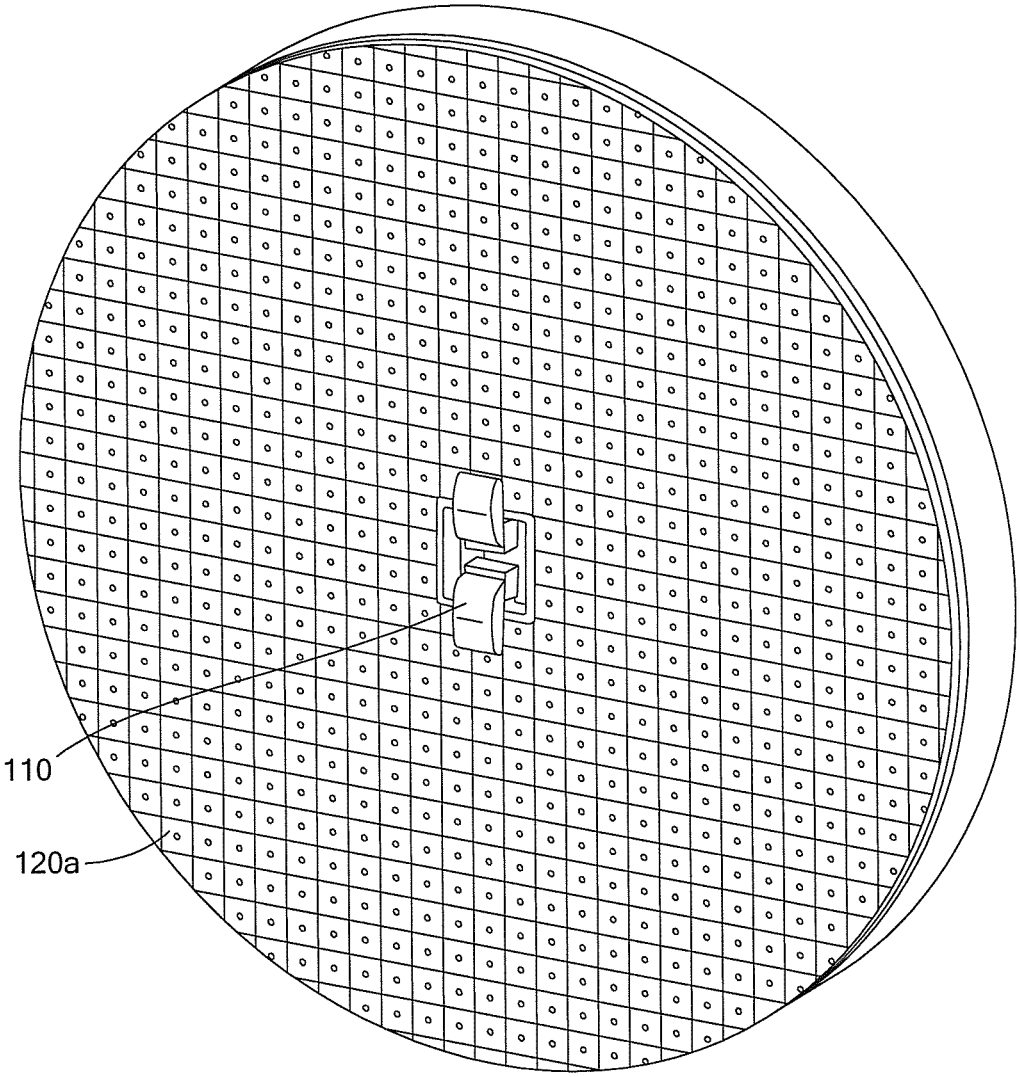
FIG. 1A is a top view of an array antenna provided from an array of ridged waveguide Vivaldi radiators (RWVR) antenna elements having an electromagnetic bandgap (EBG) ground plane.

Referring now to FIG. 1, an array 100 is comprised of a plurality of ridged waveguide Vivaldi radiator (RWVR) antenna elements 110 disposed on a substrate 120 having a surface 120*a* corresponding to a ground plane. In one embodiment, surface 120*a* is provided as an electromagnetic bandgap (EBG) ground plane 120*a*, shown in FIG. 1A. It should be appreciated that although in the exemplary embodiment of FIG. 1A, the entire surface 120*a* corresponds to an EBG ground plane, it is not necessary that the entire surface 120*a* be an EBG ground plane. Rather, it is only necessary that portions of the ground plane proximate antenna elements 110 be provided as EBG ground planes such that the height of the RWVR antenna elements is reduced compared with the height of a RWVR antenna element over a copper ground plane.

Figure 2:
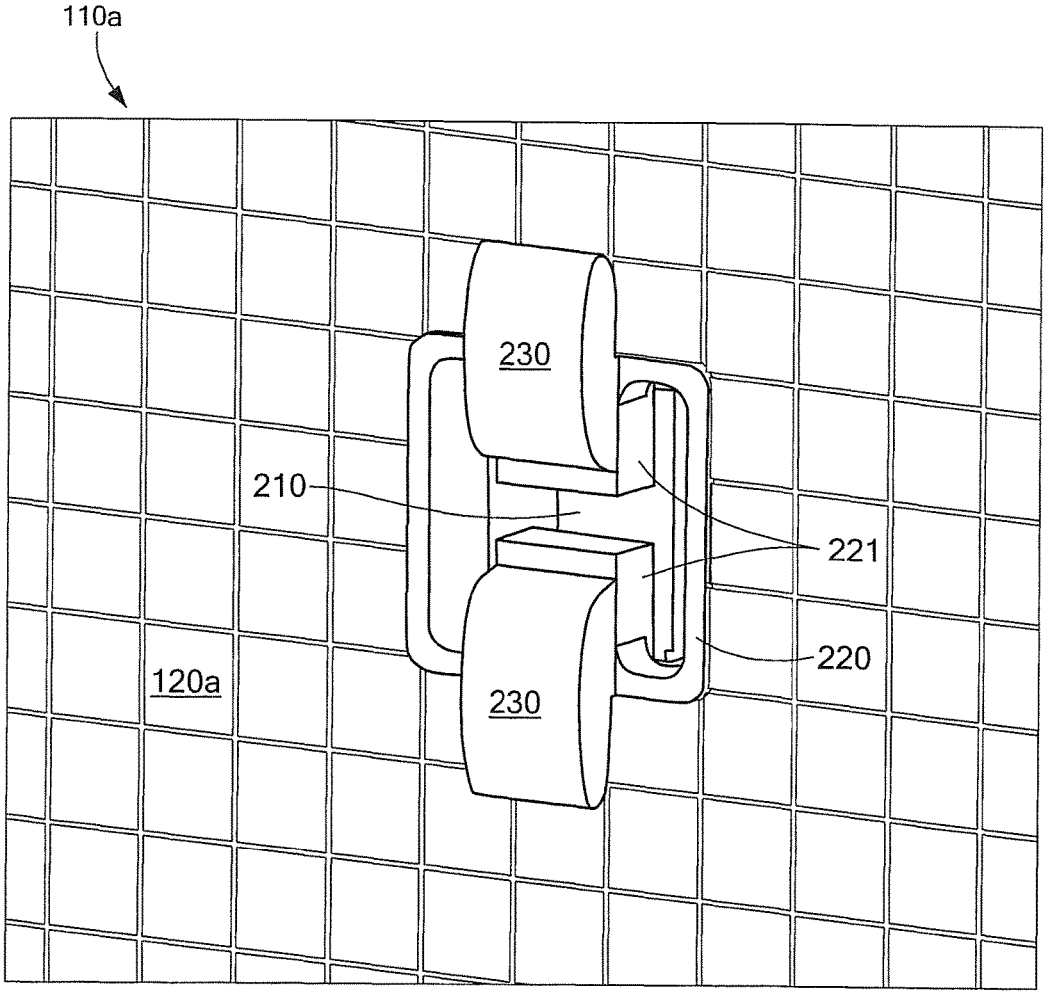
FIG. 2 is an isometric view of a RWVR antenna element.

Referring now to FIG. 2, in which like elements of FIG. 1 are provided having like reference designations, and taking antenna element 110*a* as representative of each of the antenna elements 110 in FIG. 1, an RWVR antenna element 110*a* includes a pair of Vivaldi radiators 230 coupled to a portion (i.e. ridges 221) of a ridged waveguide coupler 220. Vivaldi radiators 230 are disposed above a portion of a suspended air stripline (SAS) transmission line 210 (only a portion of which is shown in FIG. 2). Each antenna element 110*a* is thus fed by an SAS transmission line 210. Electromagnetic energy is coupled between Vivaldi radiators 230 and SAS transmission line 210 via the ridged waveguide coupler 220. As is well known in the antenna arts and as used herein, the term ridged waveguide refers to a variation of a rectangular waveguide having a single or double ridge protruding into the waveguide from the broad faces of the rectangular waveguide and Vivaldi radiators 230 gradually match the output impedance of the ridged waveguide coupler 220 to the intrinsic impedance of the medium surrounding the radiators (typically free space).

In operation, radio frequency (RF) energy is coupled between a feed network (comprising the SAS transmission line), the ridged waveguide coupler 220, and radiators 230.

Vivaldi radiators 230 are disposed over the EBG ground plane 120*a*. By using EBG ground plane 120*a*, the height of Vivaldi radiators 230 above ground plane 120*a* is reduced. Theoretically, the Vivaldi radiators 230 can be in intimate contact with the surface of ground plane 120*a*. In practical applications, the height reduction will depend upon the particular element and the manner of manufacture. Thus, by using an EBG ground plane, antenna element 110*a* is provided as a low-profile antenna element (i.e. the antenna element 110*a* is smaller in height than conventional elements). Although a Vivaldi radiator is described, those of ordinary skill in the art will realize that known RF radiating structures and devices, other than a Vivaldi radiator, can be used. For example, a horn radiator, patch radiator, or the like may also be employed to radiate electromagnetic energy into the surrounding media, which may be free space.

Referring still to FIG. 2, each RWVR antenna element 110*a* has the same configuration with a generally parallelepiped, hollow ridged waveguide coupler 220 and a pair of Vivaldi radiators 230 extending outwardly from respective surfaces of ridges 221 of coupler 220 in a direction generally perpendicular to the substrate surface 120*a* (as depicted in FIG. 1).

In some embodiments, all or portions of coupler 220 and Vivaldi radiators 230 may be separately machined or otherwise formed by conventional means from any suitable conductive material, including (without limitation) any of the metals or metal alloys commonly in use in the RF component arts or yet to be discovered. In one embodiment, radiators 230 may be formed or otherwise provided as part of ridge portions 221 which are then coupled to outer walls of coupler 220.

Alternatively, coupler 220 and Vivaldi radiators 230 may be, taken together, of a one-piece construction. In one preferred embodiment, this may be accomplished by injection molding a polymeric material into a die cavity defining the shape of the body and the ear-like arms. An important economy is achieved by making the broadband radio frequency radiating elements of one-piece construction, rather than two-piece or multiple-piece construction.

When employed, the polymeric material is most preferably glass-fiber-reinforced polyetherimide (PEI). In such an embodiment, the entire outer surface of each broadband radio frequency radiating element is coated with an electrically conductive metallization coating. Coating is preferably accomplished by electroless deposition of copper, gold, or silver to a thickness of at least about 0.0015 inches. (No such coating is required when the antenna element is machined or otherwise constructed of a conductive material.)

In a further alternate embodiment, coupler 220 and Vivaldi radiators 230 may be formed as a single piece of a conductive polymer or a part formed from molded plastic or the like that is then conductively plated through means well known in the art.

One of ordinary skill in the art will immediately recognize that the above alternate partitioning of the components of the RWVR element 110 into functional components does not necessarily imply that the functional components are physically separable or separately fabricated. Various alternate embodiments and methods of manufacture are with within the skills of an ordinary practitioner.

In contrast with other approaches, this approach requires no additional components other than ridged waveguide coupler 220 and Vivaldi radiators 230. Use is made of the ridged waveguide's dominant TE10 mode as a coupling mechanism rather than the coaxial mode employed in the prior art (such as, for example, Yu '889).

Figure 3:
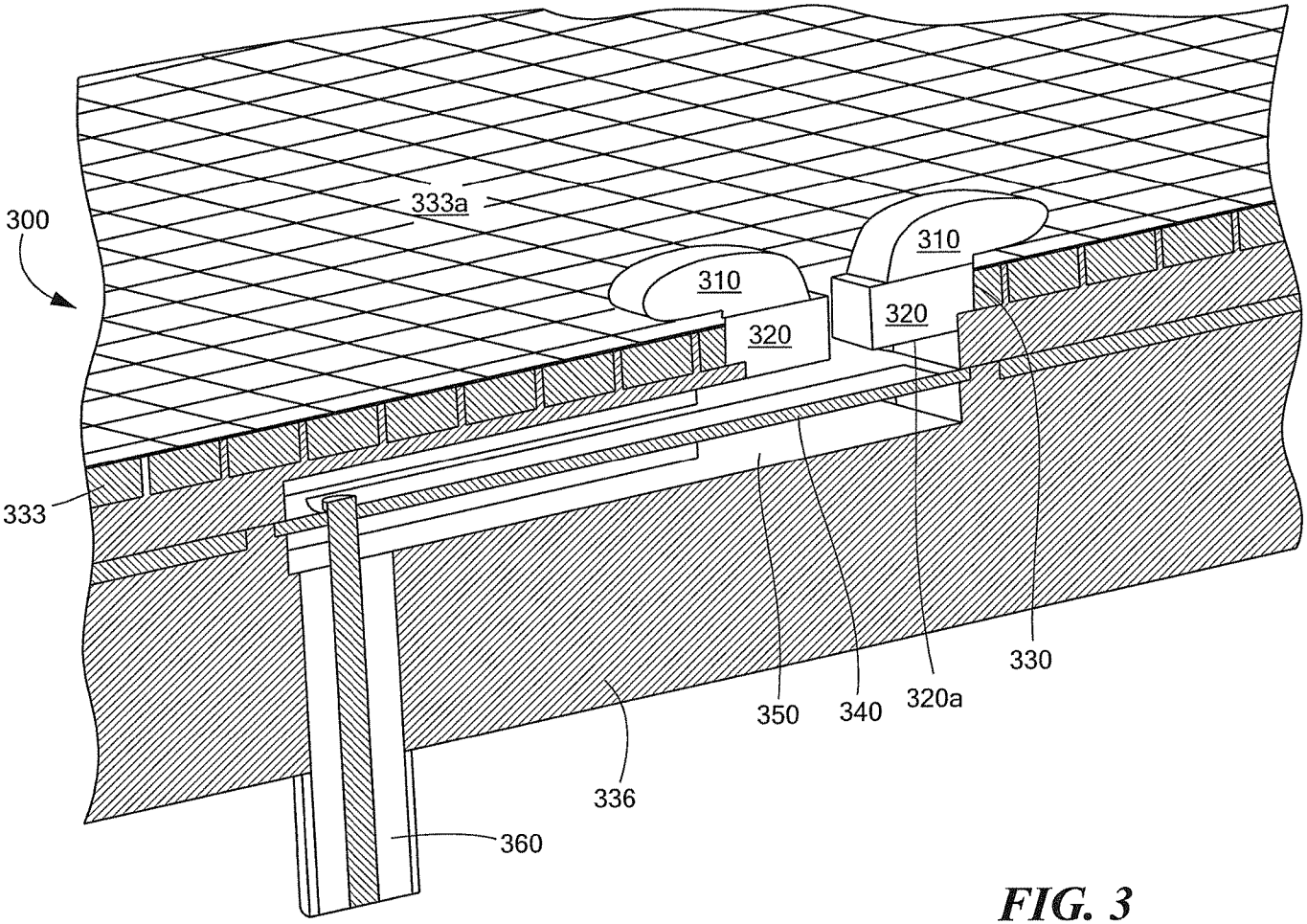
FIG. 3 is an exploded assembly view of one exemplary embodiment of a RWVR element within an array.

Referring now to FIG. 3, a portion of an array antenna 300 includes Vivaldi radiators 310, which as noted above, may be formed as a part of ridged waveguide coupler (e.g. formed as part of ridges 320) or vice versa. Alternatively, radiators and coupler structures (e.g. ridges 320) may be formed separately and joined together by any of a number of means and/or techniques well known to those of ordinary skill in the art.

Although, in the embodiments of FIGS. 2 and 3, each antenna element is provided from two Vivaldi radiators 310. Those of ordinary skill in the art will appreciate that a single Vivaldi radiator may be used (e.g. in beam-shaping applications). Likewise, in other applications, multiple radiators (e.g., four radiators located 90° apart) may be used to provide an RWVR antenna element. Accordingly, the concepts, systems, circuits, and techniques described herein are not limited to any particular number or type of Vivaldi radiators.

Ridges 320 fit into opening 330 in substrate 333. Surface 333*a* of substrate 333 acts as a ground plane for radiators 310. In some applications in which a low-profile compact antenna is desired, surface 333*a* is provided as an EBG material. In one embodiment, substrate 333 may be provided wholly or partially from an EBG material while in other embodiments substrate 333 may have an EBG material disposed thereon to provide surface 333*a* as an EBG surface at least in the regions around ridge waveguide coupler and proximate radiators 310 such that radiators 310 may be provided having a size which is reduced compared with the size of radiators disposed over a ground plane provided from a perfect electric conductor (PEC). Substrate 333 acts as a cover for baseplate 336 to define a cavity 350 therebetween.

SAS 340 is mounted or otherwise disposed in cavity 350. Preferably, the separation between the top surface of SAS 340 and the bottom-most surface 320*a* of ridges 320, when assembled, is about 0.020 inches (20 mils). Variations in spacing and dimensions adjusted to optimize the operation of the element at various frequencies are well-within the knowledge of one of ordinary skill in the art; accordingly, further discussion of such variants is not warranted.

In some embodiments, an exemplar of which is shown in FIG. 3, SAS 340 is fed by a conventional SMA connector 360, which may be soldered or otherwise coupled to SAS 340. Such a configuration may be useful for testing and characterization, or for simple arrays of directly-driven elements. In a preferred embodiment, SAS 340 is coupled to or part of a corporate stripline feed network (not shown).

Figure 4:
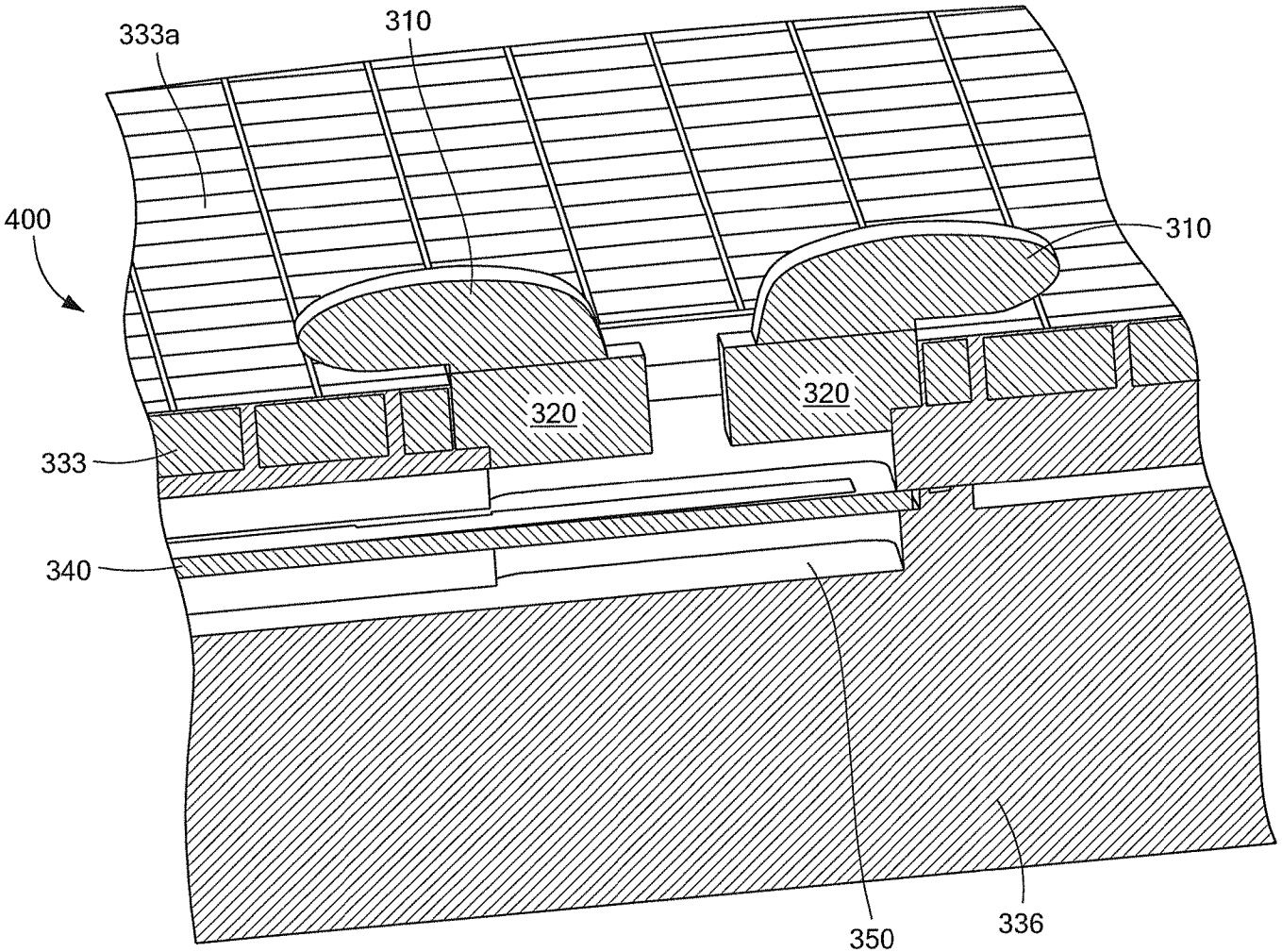
FIG. 4 is a cross-sectional view of a portion of an RWVR assembly similar to that shown in FIG. 3.

Referring now to FIG. 4, in which like elements of FIG. 3 are provided having like reference designations, an assembled antenna element 400 includes radiators 310 disposed on ridges 320 of the ridge waveguide coupler, shown in partial section. The combination of radiators 310 and ridges 320 form a radiator sub assembly, which can be mounted in opening 330 (FIG. 3) of substrate 333. The ridged waveguide coupler is provided by mounting the ridges 320 in opening 330 (shown, for clarity, in FIG. 3 only) of substrate 333 and mounting substrate 333 to baseplate 336 to thereby form cavity 350. Cavity 350, enclosing SAS 340, is thus formed by ridges 320, substrate 333, and base plate 336 and in turn, the ridged waveguide coupler is formed from ridges 320, opening 330 and cavity 350.

Figure 5A:
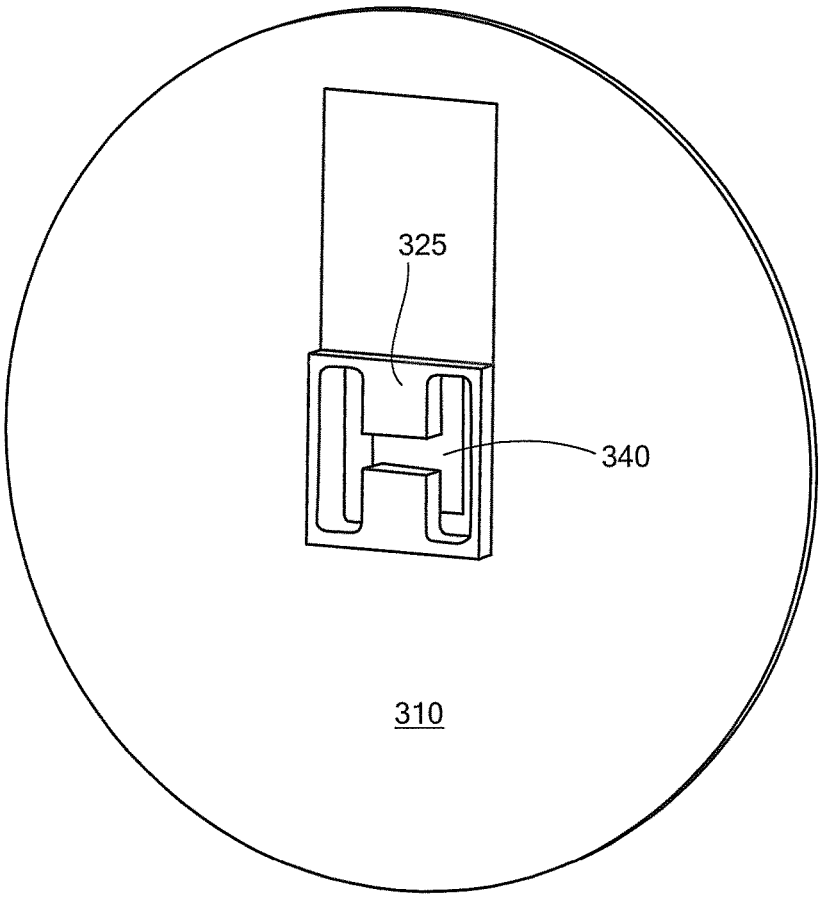
FIG. 5A is a top view of a ridged waveguide coupler disposed over a substrate.
Figure 5B:
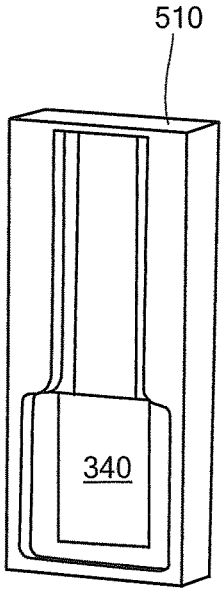
FIG. 5B is an isometric view of a suspended air stripline transmission line mounted within a cavity of an enclosure.

Referring now to FIG. 5A, substrate 310 has ridged waveguide coupler 325 disposed thereon. SAS 340 is visible through openings in the ridged waveguide coupler. FIG. 5B depicts suspended air stripline 340 inside enclosure 510, which may be the same as or similar to a cavity 350 (referring to FIGS. 3 and 4) in baseplate 336 or, alternatively, as a separate structure mounted on the backside of substrate 333.

The foregoing has discussed the RWVR antenna elements as being coupled on and through a substrate 333, which in turn acts as a cover to baseplate 336. However, one of ordinary skill in the art will appreciate that the cover/baseplate assembly make take any form and may comprise of one or multiple pieces suitably configured to support the RWVR antenna elements in whatever array format (and within any form factor) necessary. Accordingly, the support structure or housing shown is for illustration only and need not limit the configuration of an array of RWVR antenna elements.

A particular advantage of antenna structure described herein is that the assembly only requires the radiator sub-assembly (e.g. Vivaldi elements and ridges) be mounted (for example, but not by way of limitation, by using common epoxy techniques) into opening 330 of substrate 333 in order to achieve the desired performance. The need for coaxial connections, additional piece parts, and complex assemblies are eliminated.

An array's bandwidth can be severely limited by the coupling between the corporate feed structure and the elements, and/or by the elements themselves. The coupling method and the radiating elements in this design are both wideband mediums; therefore, the antenna array produces wideband results.

Another benefit of the RWVR array is its relatively high directivity. The directivity of an individual RWVR element is relatively high in comparison to other array elements such as dipoles or radiating slots.

The physical dimensions of the RWVR array are not as sensitive to its electrical performance as other antenna designs since its bandwidth is quite large, reducing the occurrence of an out-of-specification antenna. This also reduces the complexity of the manufacturing process, which in turn lowers cost.

Designing an array from RWVR elements is not limited to resonant element spacing, as is the case with radiating slots from a resonant waveguide, giving the antenna designer another degree of freedom to adjust side lobe levels. Here, the dimensions of the Vivaldi radiator and the ridged waveguide coupler may be determined using conventional design techniques given the required bandwidth (including both the low band and the high band) and desired gain for the antenna element or array. It should be appreciated that the design of an array is affected by use of an EBG ground plane to the degree such that the radiation pattern of an antenna element on the EBG ground plane may be more directional and/or symmetrical (as compared with the same antenna element on a non-EBG ground plane) thus allowing for smaller/tighter element spacing.

Antennas constructed according to the concepts, systems, and techniques disclosed herein may be designed and simulated using a software tool adapted to solve three-dimensional electromagnetic field problems. The software tool may be a commercially available electromagnetic field analysis tool such as CST Microwave Studio™, Agilent's Momentum™ tool, or Ansoft's HFSS™ tool. The electromagnetic field analysis tool may be a proprietary tool using any known mathematical method, such as finite difference time domain analysis, finite element method, boundary element method, method of moments, or other methods for solving electromagnetic field problems. The software tool may include a capability to iteratively optimize a design to meet predetermined performance targets. Accordingly, the operating frequency and/or bandwidth of the present apparatus is not limited to any particular region, but is only constrained by the physical properties of the assembly as designed.

Although an RWVR antenna element and array of RWVR antenna elements is described in the context of receiving electromagnetic energy in general, and RF signals in particular, those skilled in the art will recognize that such apparatus is equally capable of transmitting as well. Accordingly, the concepts, systems, and techniques described herein are not limited to receive antennas, but may include transmit antennas, bi-directional antennas, monopulse or other tracking systems, radars, and the like without limitation.

Figure 6:
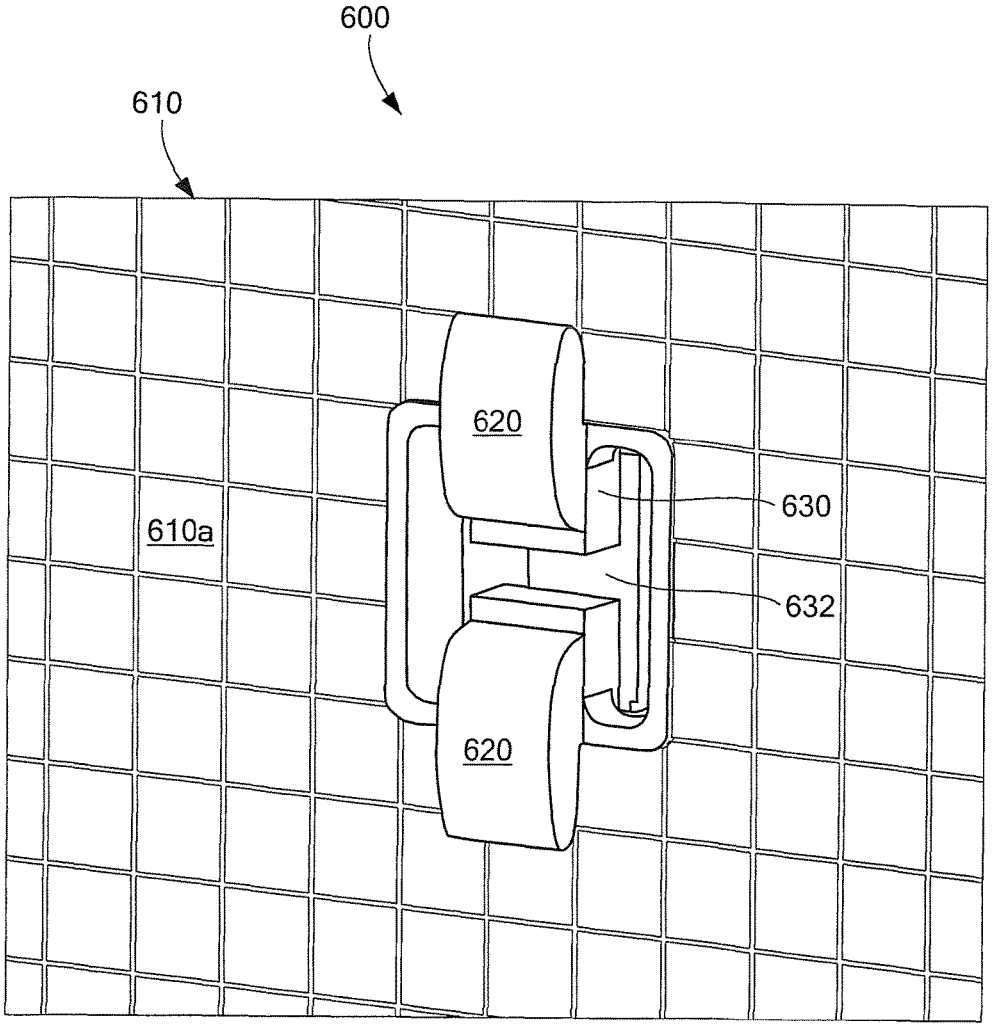
FIG. 6 is an isometric view of an RWVR antenna element having an electromagnetic bandgap (EBG) ground plane below a RWVR antenna element and surrounding a ridged waveguide transition.

Referring now to FIG. 6, an antenna element 600 includes a pair of Vivaldi radiators 620 coupled to ridges 630 of a ridged waveguide transition which couples RF energy between a suspend air stripline (SAS) transmission line 632 and the radiators 620. Vivaldi radiators 620 are disposed over an electromagnetic bandgap (EBG) ground plane 610. Use of an EBG ground plane 610 provided below the antenna element 620 reduces (or in some cases, even minimizes) the overall height of radiators 620 above ground plane surface 610*a*. The EBG ground plane 610 surrounds the ridged waveguide transition 630. By surrounding the waveguide transition, any additional array thickness necessary for the creation of the magnetic ground plane is reduced or in some cases even minimized. Reducing the height of the antenna elements 620 above ground plane 610 leads to an overall reduction in thickness of an antenna provided from an array of such elements (i.e. the antenna may be provided as a low-profile antenna). Reducing antenna array thickness reduces its inertia, which in turn significantly reduces the load on the array mounting, such as the gimbals in a missile seeker head of similar applications.

In comparison to a radiator that utilizes a perfect conducting ground plane (PEC), the height of a radiator above an EBG ground plane is approximately one-third that of an embodiment using a PEC yet still provides equivalent performance. Indeed, the two alternative embodiments (i.e. a PEC ground plane and an EBG ground plane) have been tested and have nearly identical radiation efficiencies.

Furthermore, the use of the EBG ground plane allows one to extend the operating frequency and bandwidth of an RWVR array beyond that achievable with a conventional (e.g., PEC) ground plane. This too is highly advantageous in compact antenna applications such as on missile seekers employing a gimbaled array.

Figure 7:
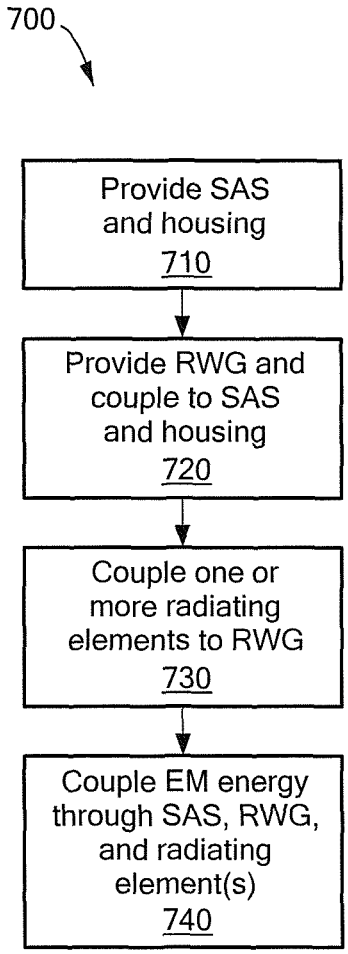
FIG. 7 is a flowchart of a method of communicating with an RWVR array according to one embodiment of the present invention.

The concepts, systems, and techniques discussed above may also be expressed in terms of a method of communicating with electromagnetic energy representing information. Such a process 700 may comprise, in one exemplary embodiment, of the steps described with regard to FIG. 7.

In step 710, a suspended air stripline (SAS) is provided, where the SAS has a proximate end and a distal end. The SAS may be enclosed (in whole or in part, without limitation) by a housing. The proximate end of the SAS may be fed, as above, from a corporate feed structure.

In step 720, a ridged waveguide (RWG) coupler is provided. The RWG coupler has a proximate end and a distal end. The proximate end of the RWG is mounted (through conventional means, without limitation) in an aperture in the SAS housing and electrically and mechanically coupled thereto. The housing's aperture is located above the distal end of the SAS.

In step 730, one or more radiating elements, such as (without limitation) a Vivaldi radiator, are coupled to the distal end of the RWG.

Finally, in step 740, electromagnetic (EM) energy (i.e., radio waves, RF signals, or the like, without limitation) is coupled from the proximate end of the SAS, through said RWG, and into free space to communicate the information represented by the electromagnetic energy or signals.

In an alternate embodiment of step 740, the EM energy may be received energy, as that conventional term is understood. In such embodiments, the EM energy is incident on the radiating elements and coupled thence through the RWG and to the SAS before leaving the apparatus through the corporate feed structure.

The order in which the steps of the present method are performed is purely illustrative in nature. In fact, the steps can be performed in any order or in parallel, unless otherwise indicated by the present disclosure.

As used herein, "plurality" means two or more. As used herein, a "set" of items may include one or more of such items. As used herein, whether in the Detailed Description or the Claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first," "second," "third," etc., to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

As is known in the art, a radio frequency (RF) antenna for use in a microwave radar radiates or receives energy in a frequency range typically of about 1-20 GHz (gigahertz), but may be higher or lower. Depending upon the needs of a particular application, the RF antenna may be structured to radiate or receive energy over a broad bandwidth or a narrow bandwidth. RF antennas are widely used in both commercial military applications such as aircraft and missile guidance.

In an array antenna, and considering a transmit mode, the RF energy needed to excite individual radiating antenna elements typically originates from a single RF source. The energy is then distributed to all antenna elements through a feed network. To have the array antenna operate across a relatively wide instantaneous bandwidth, the feed network often uses a corporate architecture with matched four port power dividers (one port is terminated in a matched load) performing the RF power distribution. Such corporate feed structures are well known in the art.

A number of different types of RF antennas are also well known. Some RF antennas are provided from waveguide antenna elements which direct RF energy in a selected direction and radiate the RF energy outwardly into free space (or equivalently, receives energy radiated through free space).

The radiating elements may include conventional waveguides, waveguide horns, and various other forms. In most applications, the operational bandwidth of a waveguide or waveguide horn is typically considered to be the range of electromagnetic waves that can propagate within the waveguide as a single fundamental mode (a/k/a a dominant mode) or a pair of orthogonal fundamental modes. The addition of conductive ridges in the walls of a waveguide (typically referred to as a "ridged waveguide" or RWG) is known to increase the bandwidth of the waveguide.

The principal known techniques for fabricating RF antennas that utilize waveguides include foil forming, dip brazing, and electroforming of metallic-based structures. Individual antenna elements are fastened to the feed structure by mechanical fasteners, adhesives, or solders. Mechanical fasteners are time-consuming to install. Adhesives typically require careful application and curing at elevated temperature for an extended period of time. Solders are sometimes difficult to use, especially when there is an attempt to achieve precision alignment of soldered structures. Additionally, all of these techniques result in a relatively heavy antenna structure, which is undesirable in a flight-worthy vehicle.

We claim:

1. An antenna, comprising:

a suspended air stripline (SAS) disposed in a housing, said SAS having a proximate end and a distal end;

a ridged waveguide coupler, having a proximate end and a distal end, said proximate end of said ridged waveguide coupler disposed substantially in an aperture in said housing and coupled thereto, said aperture located above said distal end of said SAS;

an electromagnetic bandgap (EBG) ground plane disposed on said housing substantially surrounding said ridged waveguide coupler; and one or more radiating elements coupled to the distal end of said ridged waveguide coupler, wherein said one or more radiating elements are configured to couple electromagnetic energy from the proximate end of said SAS, through said ridged waveguide coupler, and into free space.

2. The antenna of claim 1, wherein said EBG ground plane is comprised of a photonic bandgap material.

3. The antenna of claim 1, wherein said EBG ground plane is comprised of a metamaterial.

4. The antenna of claim 1, wherein said one or more radiating elements comprise a number of elements selected from the group consisting of one, two, and four.

5. The antenna of claim 1, further comprising a corporate feed network coupled to said proximate end of said SAS.

6. The antenna of claim 1, wherein said SAS, said ridged waveguide coupler, and said one or more radiating elements are each configured to optimally transmit electromagnetic signals in at least one of the C, X, Ku, and Ka-band.

7. The antenna of claim 1, wherein said one or more radiating elements comprise a Vivaldi radiator.

8. The antenna of claim 1, wherein said one or more radiating elements comprise a flared radiator.

9. The antenna of claim 1, wherein said one or more radiating elements comprise a horn radiator.

10. The antenna of claim 1, wherein said one or more radiating elements comprise a spiral radiator.

11. The antenna of claim 1, wherein at least one of said one or more radiating elements and said ridged waveguide coupler are comprised of a conductive material.

12. The antenna of claim 1, wherein at least one of said one or more radiating elements and said ridged waveguide coupler are comprised of a conductive polymer.

13. The antenna of claim 1, wherein at least one of said one or more radiating elements and said ridged waveguide coupler are comprised of a non-conductive polymer with a conductive surface coating.

14. The antenna of claim 1, wherein said one or more radiating elements and said ridged waveguide coupler are monolithically formed such that, when taken together, said one or more radiating elements and said ridged waveguide coupler are of a one piece construction.

15. The antenna of claim 1, wherein said antenna is a receive antenna.

16. The antenna of claim 1, wherein said antenna is a transmit antenna.

17. The antenna of claim 1, wherein said antenna is configured to both receive and transmit electromagnetic energy.

18. A method of communicating with electromagnetic energy representing information, comprising:

furnishing a suspended air stripline (SAS) disposed in a housing, said SAS having a proximate end and a distal end;

furnishing a ridged waveguide coupler having a proximate end and a distal end, said proximate end of said ridged waveguide coupler disposed substantially in an aperture in said housing and coupled thereto, said aperture located above said distal end of said SAS;

placing an electromagnetic bandgap (EBG) ground plane on said housing substantially surrounding said ridged waveguide coupler;

attaching one or more radiating elements coupled to the distal end of said ridged waveguide coupler; and coupling a supplied electromagnetic energy from the proximate end of said SAS, through said ridged waveguide coupler, and into free space through use of the ridged waveguide coupler's transverse electric ten ($TE_{10}$) mode as a coupling mechanism and without a coaxial cable between said one or more radiating elements and said SAS to communicate said information represented thereby.

19. The method of claim 18, wherein said ERG ground plane is comprised of a photonic bandgap material.

20. The method of claim 18, wherein said ERG pound plane is comprised of a metamaterial.

21. The method of claim 18, further comprising furnishing a corporate feed network coupled to said proximate end of said SAS.

22. The method of claim 18, wherein said SAS, said ridged waveguide coupler, and said one or more radiating elements are each configured to optimally transmit electromagnetic signals in at least one of the C, X, Ku, and Ka-band.

23. The method of claim 18, wherein said one or more radiating elements comprise a Vivaldi radiator.

24. An apparatus, comprising:

a suspended air stripline (SAS) disposed in a housing, said SAS having a proximal end and a distal end;

a ridged waveguide coupler having a proximate end and a distal end, said proximal end of said ridged waveguide coupler disposed substantially in an aperture in said housing and coupled thereto, said aperture located above said distal end of said SAS;

an electromagnetic bandgap (EBG) ground plane on said housing substantially surrounding said ridged waveguide coupler;

one or more radiating elements coupled to the distal end of said ridged waveguide coupler; and a connector for coupling a supplied electromagnetic energy to the proximal end of said SAS, such that electromagnetic energy is coupled through said ridged waveguide coupler, and into free space through use of the ridged waveguide couplers transverse electric ten ($TE_{10}$) mode as a coupling mechanism and without a coaxial cable between said one or more radiating elements and said SAS to communicate said information represented thereby.

* * * * *